US009004633B2

(12) United States Patent
Yanagisawa

(10) Patent No.: US 9,004,633 B2
(45) Date of Patent: Apr. 14, 2015

(54) INK-JET RECORDING APPARATUS

(71) Applicant: Mimaki Engineering Co., Ltd., Nagano (JP)

(72) Inventor: Shota Yanagisawa, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 0 days.

(21) Appl. No.: 14/358,225

(22) PCT Filed: Nov. 13, 2012

(86) PCT No.: PCT/JP2012/079397
§ 371 (c)(1),
(2) Date: May 15, 2014

(87) PCT Pub. No.: WO2013/073527
PCT Pub. Date: May 23, 2013

(65) Prior Publication Data

US 2014/0313253 A1 Oct. 23, 2014

(30) Foreign Application Priority Data

Nov. 18, 2011 (JP) ..... 2011-252567

(51) Int. Cl.
*B41J 29/38* (2006.01)
*B41J 2/045* (2006.01)

(52) U.S. Cl.
CPC ..... *B41J 2/04541* (2013.01); *B41J 2/04525* (2013.01); *B41J 2/04581* (2013.01); *B41J 2/04588* (2013.01); *B41J 2/04596* (2013.01)

(58) Field of Classification Search
USPC ..... 347/9, 10, 11, 5; 239/4
See application file for complete search history.

(56) References Cited

U.S. PATENT DOCUMENTS 6,857,715 B2 * 2/2005 Darling ..... 347/11
7,073,727 B2 * 7/2006 Usuda ..... 239/4

FOREIGN PATENT DOCUMENTS

| | | |
|---|---|---|
| JP | H09-052360 | 2/1997 |
| JP | 3275965 | 4/2002 |
| JP | 2002-144560 | 5/2002 |
| JP | 2011-031442 | 2/2011 |
| JP | 2011-132536 | 7/2011 |

OTHER PUBLICATIONS

"International Search Report (Form PCT/ISA/210) of PCT application", mailed on Dec. 25, 2012, with English translation thereof, p. 1-p. 4 in which the listed references (JP2011-031442, JP2002-144560, JPH09-052360 and JP2011-132536) were cited.

* cited by examiner

*Primary Examiner* — Lam S Nguyen
(74) *Attorney, Agent, or Firm* — Jianq Chyun IP Office

(57) ABSTRACT

To provide an ink jet recording apparatus in which the residual vibration of any ink can be prevented to avoid the spread of the ink at an opening portion and to perform the continuous discharge of the ink stably. An ink-jet recording apparatus includes a recording head including a pressure chamber and a nozzle, the pressure chamber containing ink, the nozzle communicating with the pressure chamber and having an opening portion formed therein to discharge the ink, a piezoelectric element forming part of the pressure chamber, and a driving signal producing section producing a driving signal to be input to the piezoelectric element to change the volume of the pressure chamber.

10 Claims, 5 Drawing Sheets

INK-JET RECORDING APPARATUS

CROSS-REFERENCE TO RELATED APPLICATION

This application is a 371 of international application of PCT application serial no. PCT/JP2012/079397, filed on Nov. 13, 2012, which claims the priority benefit of Japan application no. JP 2011-252567, filed on Nov. 18, 2011. The entirety of each of the above-mentioned patent applications is hereby incorporated by reference herein and made a part of this specification.

TECHNICAL FIELD

The present invention relates to an ink-jet recording apparatus having a recording head which discharges ink by deforming part of a pressure chamber communicating with a nozzle, when ink is discharged from the recording head.

BACKGROUND ART

In an ink-jet recording apparatus which discharges ink from a recording head to a medium, the recording head is provided with a nozzle having a plurality of small opening portions formed therein and with a pressure chamber communicating with the nozzle.

The pressure chamber has a wall face partially formed of piezoelectric element. The piezoelectric element vibrates such that a voltage applied to the piezoelectric element can change the volume of the pressure chamber.

FIG. 5 shows a typical example of the voltage applied to the piezoelectric element.

Referring to the example, the voltage applied to the piezoelectric element is first reduced from a voltage VH at which the interior of the pressure chamber is contracted to a voltage VL at which the interior of the pressure chamber is expanded. Subsequently, the voltage VL is maintained to wait for the timing for discharging ink.

Then, the voltage applied to the piezoelectric element is increased to VH to set the interior of the pressure chamber in the contracted state. Since the interior of the pressure chamber is contracted at this point, the ink is discharged from the nozzle.

In an ink-jet recording apparatus disclosed in Patent Literature 1, a pressure chamber is first contracted to raise a central area of a meniscus of ink at a nozzle opening portion of a recording head toward a media to start the discharge of the ink. By the time when the speed of a rear end portion of the ink starting to be discharged at the nozzle opening portion reaches zero, an expansion step is performed in which the pressure chamber is expanded to pull an outer edge portion of the meniscus, the central area of which was raised at the contraction step.

According to such a method, only the drop of ink starting to be discharged is discharged.

CITATION LIST

Patent Literature

Patent Literature 1: Japanese Patent No. 3275965

SUMMARY OF INVENTION

Technical Problem

A conventionally known problem is so-called residual vibration in which the ink vibrates in the same direction as the vibration direction of the piezoelectric element after the ink is discharged.

The present inventors conducted a study to prevent the residual vibration by using ink having a relatively low viscosity and performed a driving method with such ink as described in Patent Literature 1 to encounter problems in which the residual vibration cannot be prevented effectively, and thus the continuous discharge of the ink is not performed stably and the ink spreads from the opening portion of the nozzle.

Especially when the ink has a low viscosity, the residual vibration cannot be prevented effectively, and the phenomenon of the ink spread is likely to occur.

The present invention has been made to solve the problems, and it is an object thereof to provide an ink-jet recording apparatus in which the residual vibration of any ink can be prevented to avoid the spread of the ink at an opening portion and to perform the continuous discharge of the ink stably.

Solution to Problem

According to the present invention, an ink-jet recording apparatus includes a recording head including a pressure chamber and a nozzle, the pressure chamber containing ink, the nozzle communicating with the pressure chamber and having an opening portion formed therein to discharge the ink, a piezoelectric element forming part of the pressure chamber, and a driving signal producing section producing a driving signal to be input to the piezoelectric element to change the volume of the pressure chamber, wherein the driving signal producing section produces the driving signal to perform a first expansion step of expanding the pressure chamber, a first contraction step of contracting the pressure chamber to discharge the ink after the first expansion step, and a second contraction step of contracting the pressure chamber in a timing in which a meniscus is pulled into a direction opposite to a discharge direction after the first contraction step, and the driving signal output by the driving signal producing section is set such that a potential at an end point of the second contraction step is set to be positioned in a range opposite to a potential at an end point of the first expansion step with respect to a potential at a starting point of the first expansion step, and such that the potential at the starting point of the first expansion step is set to be substantially the same as a potential at a starting point of the second contraction step.

According to the present invention employing the configuration, the residual vibration of the ink can be prevented even when the ink has a low viscosity. This can avoid the spread of the ink at the opening portion of the nozzle and stably perform the continuous discharge of the ink even in fast discharge (when the ink discharge frequency is in a high-frequency region).

Specifically, the first expansion step is first performed to expand the interior of the pressure chamber to pull the meniscus into the direction opposite to the discharge direction, and the first contraction step is performed to contract the pressure chamber to discharge the ink. After the discharge of the ink, the meniscus is moved in the direction opposite to the discharge direction. At this point, the second contraction step is performed such that the potential at the end point of the second contraction step is positioned in the range opposite to the potential at the end point of the first expansion step with respect to the potential at the starting point of the first expansion step. The step can contract the pressure chamber so as to move the meniscus in the discharge direction, thereby suppressing the residual vibration. In addition, the potential at the starting point of the first expansion step is set to be substantially the same as the potential at the starting point of the second contraction step. This can reduce the number of parameters set to optimize the driving signal and the like for suppressing the residual vibration of the meniscus in short time and after the ink discharge as compared with the case where the potentials at the starting points of the first expansion step and the second contraction step are different from each other, with the result that the optimization can be performed efficiently.

In the ink-jet recording apparatus according to the present invention, the driving signal producing section preferably produces the driving signal such that a second holding step of holding the volume of the pressure chamber set after the first contraction step is performed between the first contraction step and the second contraction step to allow start of contraction of the pressure chamber in the second contraction step in a timing in which the meniscus is first pulled into the direction opposite to the discharge direction after the ink is discharged in the first contraction step.

For example, in employing the configuration in which the residual vibration of the meniscus is suppressed by expanding the pressure chamber, it is necessary to expand the pressure chamber in a timing in which the meniscus once pulled into the direction opposite to the discharge direction after the ink discharge in the first contraction step is further moved in the discharge direction. The configuration of the present invention can be used to contract the pressure chamber in the second contraction step in the timing in which the meniscus is first pulled into the direction opposite to the discharge direction after the ink discharge in the first contraction step, thereby suppressing the residual vibration. As compared with the configuration in which the residual vibration of the meniscus is suppressed by expanding the pressure chamber, the time taken for the suppression of the residual vibration can be shortened.

In the ink-jet recording apparatus according to the present invention, the driving signal producing section preferably produces the driving signal such that a second expansion step of expanding the pressure chamber to return to the same potential as that at the starting point of the first expansion step is performed after the second contraction step.

To perform the next discharge operation under the same conditions as those in the previous discharge operation, it is necessary to match the volume of the pressure chamber at the starting point of the first expansion step in the next discharge operation with the volume at the starting point of the first expansion step in the previous discharge operation. According to the configuration, since the volume of the pressure chamber is returned to the volume at the starting point of the first expansion step after the second expansion step is performed, so that the first expansion step in the next discharge step can be started smoothly.

In the ink-jet recording apparatus according to the present invention, the driving signal producing section preferably produces the driving signal such that a third holding step of holding the volume of the pressure chamber set after the second contraction step is performed between the second contraction step and the second expansion step to allow start of expansion of the pressure chamber in the second expansion step in a timing in which the meniscus is first moved in the discharge direction after a force of moving the meniscus in the discharge direction is applied in the second contraction step.

According to the configuration, since the second expansion step of applying the force in the direction opposite to the discharge direction is started in the timing in which the meniscus is moved in the discharge direction after the residual vibration is suppressed in the second contraction step. This can further suppress the residual vibration.

In the ink-jet recording apparatus according to the present invention, the second contraction step is preferably started at the time when the meniscus is at the maximum speed of movement pulled into the direction opposite to the discharge direction.

According to this, the suppression of the residual vibration in the second contraction step can be performed in the most efficient timing.

In the ink-jet recording apparatus according to the present invention, the driving signal producing section preferably produces the driving signal such that a first holding step of holding the volume of the pressure chamber set after the first expansion step is performed between the first expansion step and the first contraction step to allow start of the discharge of the ink in the first contraction step in a timing in which the meniscus is first moved in the discharge direction after a force of moving the meniscus in the direction opposite to the discharge direction is applied in the first expansion step.

The configuration can be used to perform the first contraction step which is the step of discharging the ink drop in the timing in which the meniscus is first moved in the discharge direction after the meniscus is pulled into the direction opposite to the discharge direction in the first expansion step, so that the discharge of the ink drop can be performed reliably. With the first holding step provided in this manner, the meniscus is once pulled into the direction opposite to the discharge direction in the first expansion step, the operation waits until the movement of the meniscus in the direction opposite to the discharge direction is stopped and turned in the first holding step, and then the first contraction step is performed at the time when the meniscus is moved in the discharge direction, so that the ink discharge can be performed smoothly and stably.

In the ink-jet recording apparatus according to the present invention, the first contraction step is preferably started at the time when the meniscus is at the maximum speed of movement in the discharge direction.

According to this, the discharge of the ink drop in the first contraction step can be performed in the most efficient timing.

In the ink-jet recording apparatus according to the present invention, the second expansion step is preferably started at the time when the meniscus is at the maximum speed of movement in the discharge direction.

According to this, the suppression of the residual vibration in the second expansion step can be performed in the most efficient timing.

In the ink-jet recording apparatus according to the present invention, each of a half of a vibration period of the meniscus in the first expansion step and the first holding step, of a half of a vibration period of the meniscus in the first contraction step and the second holding step, and of a half of a vibration period of the meniscus in the second contraction stop and the third holding step preferably ranges between Tc/4 to 1Tc where Tc represents the Helmholtz vibration period.

According to this, each of the steps can be performed in the preferable timing appropriate for the meniscus vibration to suppress the residual vibration effectively.

In the ink-jet recording apparatus according to the present invention, the first expansion step, the first holding step, the first contraction step, the second holding step, the second contraction step, the third holding step, and the second expansion step preferably have the same step time, and the step time preferably corresponds to Tc/4 where Tc represents the Helmholtz vibration period.

According to this, the optimal step time appropriate for the type of the ink can be set.

In the ink-jet recording apparatus according to the present invention, a potential difference between a starting point and an end point of the driving signal to perform the first expansion step is preferably larger than a potential difference between a starting point and an end point of the driving signal to perform the second expansion step.

Advantageous Effect of Invention

According to the ink-jet recording apparatus of the present invention, the residual vibration can be prevented even when the ink has a relatively low viscosity, so that the spread of the ink at the opening portion can be avoided and the stable and continuous discharge of the ink can be achieved.

DESCRIPTION OF EMBODIMENTS

A preferred embodiment of the present invention will hereinafter be described with reference to the drawings.

Figure 1:
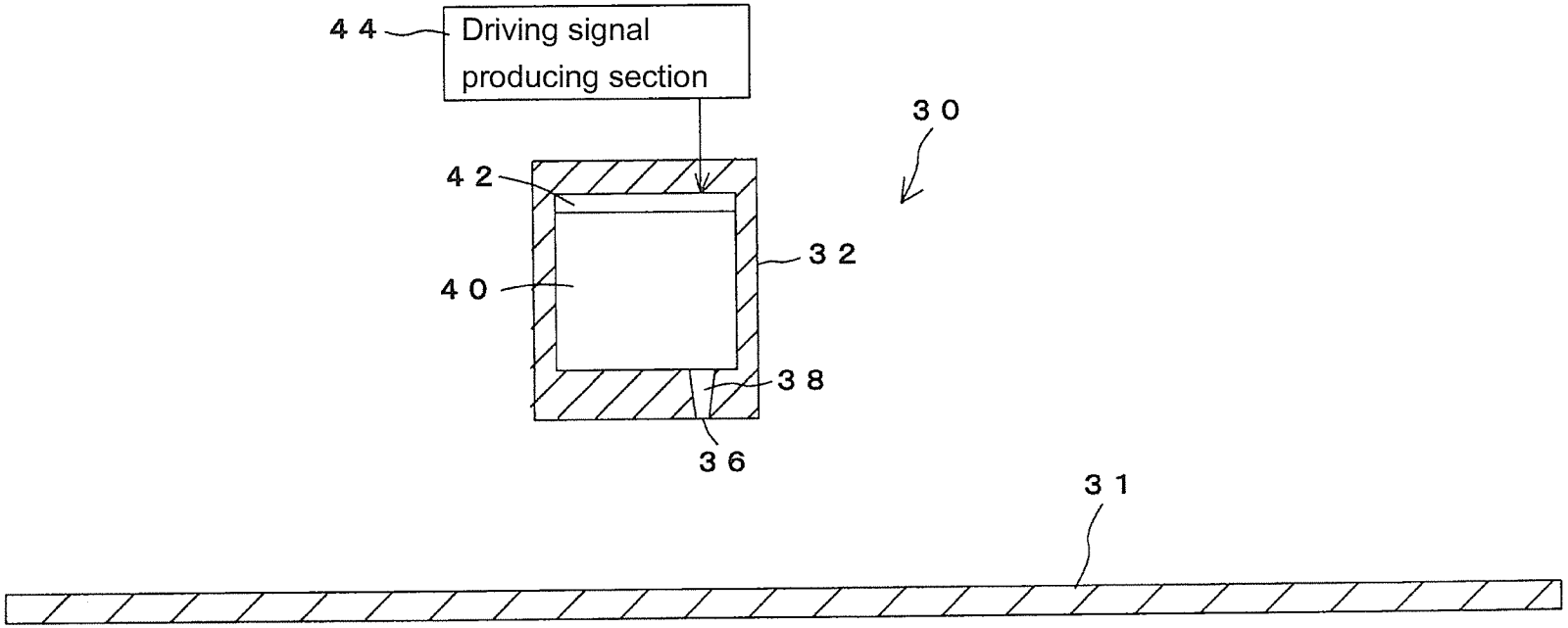
FIG. 1 is a schematic diagram of an ink-jet recording apparatus according to the present invention.

FIG. 1 is a schematic diagram of an ink-jet recording apparatus.

An ink-jet recording apparatus 30 is an apparatus performing printing on a medium 31 through ink jet, and includes a recording head 32 which discharges ink onto the medium 31, and an ink tank (not shown) which stores the ink to be supplied to the recording head 32.

The recording head 32 includes a nozzle 38 having an opening portion 36 formed therein for discharging the ink, and a pressure chamber 40 containing the ink. A portion of a wall face constituting the pressure chamber 40 is formed of a piezoelectric element 42. The piezoelectric element 42 deforms upon application of a predetermined voltage. The deformation of the piezoelectric element 42 changes the volume of the pressure chamber 40 to allow the ink contained in the pressure chamber 40 to be discharged through the nozzle 38.

The operation of the piezoelectric element 42 is controlled with a pulse voltage produced by a driving signal producing section 44.

The driving signal producing section 44 may have any configuration that can output the pulse voltage in a preset timing. For example, a microprocessor having a built-in ROM or RAM can be used as the driving signal producing section 44. A control program capable of producing the predetermined pulse voltage in the predetermined timing is stored in the ROM.

Figure 2:
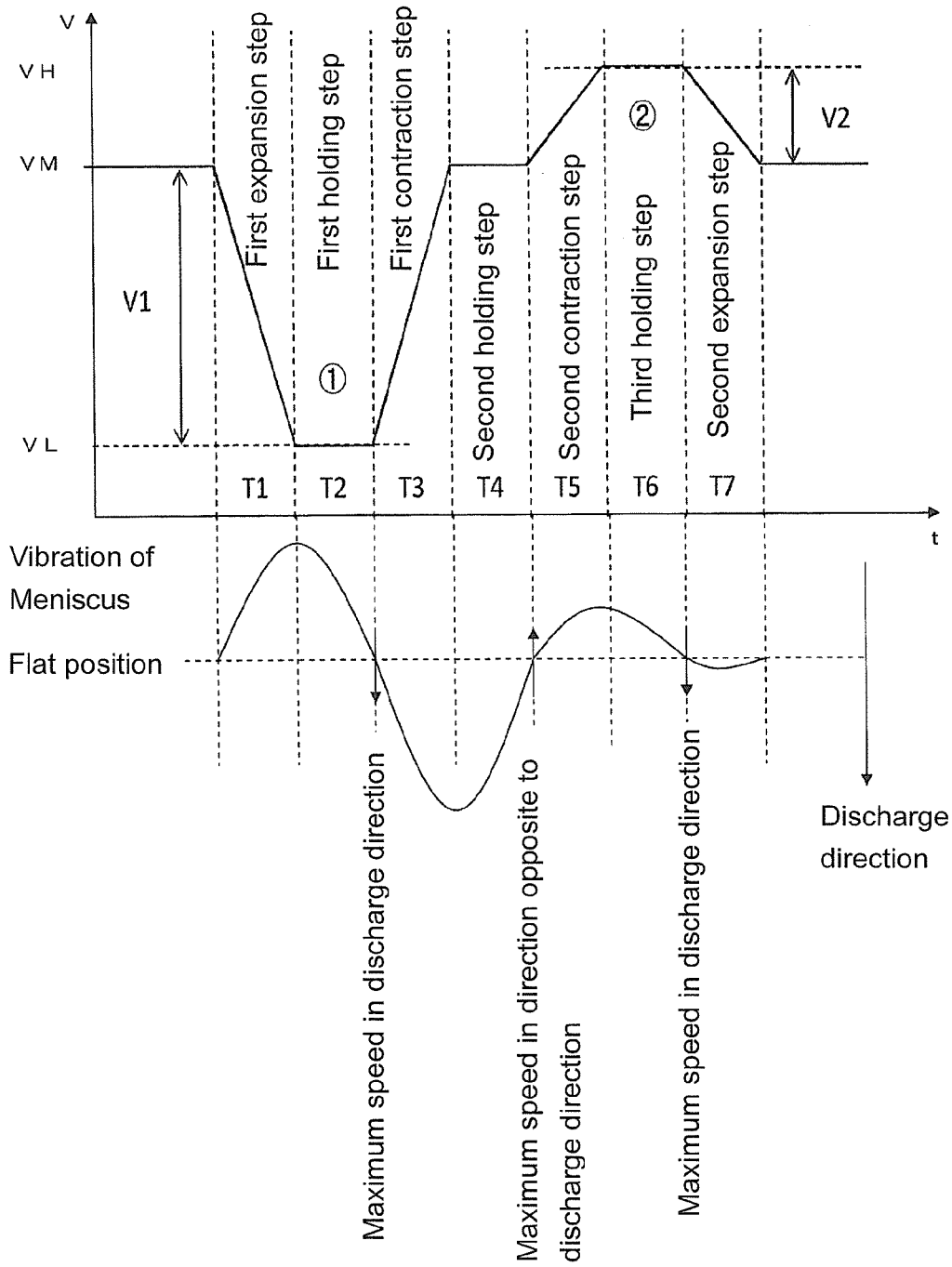
FIG. 2 is an explanatory drawing showing the waveform of a voltage applied to a piezoelectric element in the present embodiment and the vibration waveform of a meniscus.

FIG. 2 shows the waveform of a driving signal in the present embodiment and the waveform schematically showing the position state of a meniscus. For the position of the meniscus, a lower part indicates a discharge direction, and an upper part indicates a pulling direction opposite to the discharge direction. For the driving signal, the horizontal axis represents time (t) and the vertical axis represents the voltage value (v) of the driving signal.

The driving signal producing section 44 first reduces the voltage applied to the piezoelectric element 42 from a voltage value VM to VL so as to expand the interior of the pressure chamber 40 (in a direction in which the volume is increased). The time taken for the voltage value to be reduced from VM to VL is T1. In other words, the volume of the pressure chamber 40 is expanded by a predetermined amount for the time T1. This corresponds to a first expansion step referred to in the claims.

At the end of the first expansion step, the meniscus is at the position where it is pulled most in the direction opposite to the discharge direction.

Next, the driving signal producing section 44 holds the voltage applied to the piezoelectric element 42 at the voltage value VL. This holds the pressure chamber 40 expanded, and the next discharge timing is waited for. The voltage is held at VL for a holding time T2. This corresponds to a first holding step referred to in the claims. In the first holding step, the meniscus, once pulled into the direction opposite to the discharge direction in the first expansion step, is turned to the discharge direction, and waits until it reaches the maximum speed in the discharge direction.

Thus, in the first holding step, the timing is waited for so as to allow the start of the discharge at the maximum speed of the meniscus in the discharge direction in a subsequent first contraction step.

After the voltage VL is held for the predetermined time, the driving signal producing section 44 increases the voltage applied to the piezoelectric element 42 from VL to VM. This increase in the applied voltage causes the piezoelectric element 42 to operate such that the interior of the pressure chamber 40 is contracted.

The contraction of the pressure chamber 40 allows the ink in the pressure chamber 40 to be discharged through the nozzle 38. The time taken for the voltage value to be increased from VL to VM is T3. In other words, the volume of the pressure chamber 40 is contracted by a predetermined amount for the time T3. This corresponds to the first contraction step referred to in the claims.

In the present embodiment, the first contraction step is started at the maximum speed of the turned meniscus in the discharge direction and is ended at the position of the meniscus protruding most in the discharge direction.

Next, the driving signal producing section 44 holds the voltage applied to the piezoelectric element 42 at the voltage VM. Thus, the volume of the pressure chamber 40 remains contracted. This corresponds to a second holding step referred to as in the claims.

The starting point of the second holding step is the position where the ink is discharged by the contraction of the pressure chamber 40 in the previous first contraction step and the meniscus is moved most in the discharge direction. Then, the meniscus is turned to the direction opposite to the discharge direction and is moved in the direction opposite to the discharge direction. The end point of the second holding step is the time when the meniscus is at the maximum speed in the direction opposite to the discharge direction. Thus, in the second holding step, the timing is waited for such that pressing in the discharge direction can be started at the maximum speed of the meniscus in the direction opposite to the discharge direction in a subsequent second contraction step.

The voltage VM is held in the second holding time for a time T4.

After the second holding step, the driving signal producing section 44 outputs a driving signal to increase the voltage applied to the piezoelectric element 42 to a voltage VH higher than the applied voltage VM in the initial state in order to further contract the pressure chamber 40. This corresponds to a second contraction step.

The voltage VH applied to the piezoelectric element 42 in the second contraction step has a value which causes the contraction of the pressure chamber 40 but does not cause the discharge of the ink.

The starting point of the second contraction step is the time when the meniscus is at the maximum speed in the direction opposite to the discharge direction. In other words, the second contraction step functions to cause the meniscus to be pressed in the discharge direction when the meniscus is at the maximum speed in the direction opposite to the discharge direction. The end point of the second contraction step is the position where the meniscus is pulled most into the direction opposite to the discharge direction.

Since the second contraction step allows the force in the discharge direction to be applied to the meniscus when the meniscus is at the maximum speed in the direction opposite to the discharge direction, the residual vibration of the meniscus can be suppressed. The applied voltage at the starting point of the second contraction step is VM that has the same value as the applied voltage VM at the starting point of the first expansion step.

The time for the applied voltage to be increased from VM to VH in the second contraction step is T5.

For the driving signal produced by the driving signal producing section 44, the potential VH at the end point of the second contraction step is set to be positioned in the range opposite to the potential VL at the end point of the first expansion step with respect to the potential VM at the starting point of the first expansion step, and this means that, if the potential at the end point of the first expansion step is higher than the potential VM at the starting point of the first expansion step, the potential at the end point of the second contraction step is set to be lower, and vice versa.

In the present embodiment, the applied voltage is set from the high potential to the low potential for expanding the pressure chamber, and the applied voltage is set from the low potential to the high potential for contracting the pressure chamber. As a result, the potential VL at the end point of the first expansion step is on the lower pressure side relative to the potential VM at the starting point of the first expansion step, and the potential VH at the end point of the second contraction step is on the higher pressure side. In contrast to the present embodiment, however, the applied voltage may be set from the low potential to the high potential for expanding the pressure chamber, and the applied voltage may be set from the high potential to the low potential for contracting the pressure chamber.

Next, the driving signal producing section 44 holds the voltage applied to the piezoelectric element 42 at the voltage VH. Thus, the volume of the pressure chamber 40 remains contracted at the applied voltage VH. This corresponds to a third holding step referred to in the claims.

The starting point of the third holding step is the position where the meniscus moved in the direction opposite to the discharge direction is moved most in the discharge direction by the contraction of the pressure chamber 40 in the previous second contraction step. Then, the meniscus is turned to the discharge direction and is moved in the discharge direction. The end point of the third holding step is the time when the meniscus is at the maximum speed in the discharge direction. Thus, in the third holding step, the timing is waited for such that the pull of the meniscus can be started in the direction opposite to the discharge direction at the maximum speed in the discharge direction in a subsequent second expansion step.

The voltage VH is held in the third holding step for a time T6.

Next, the driving signal producing section 44 outputs a driving signal to reduce the voltage applied to the piezoelectric element 42 from the voltage VH to the voltage VM in the initial state.

Thus, the time taken for the voltage value reduced from VH to VM is T7. In other words, the volume of the pressure chamber 40 is expanded by a predetermined amount for the time T7. This corresponds to a second expansion step referred to in the claims.

The starting point of the second expansion step is the time when the meniscus is at the maximum speed in the discharge direction. The second expansion step functions to cause the meniscus to be pressed in the discharge direction when the meniscus is at the maximum speed in the discharge direction. The end point of the second contraction step is the position where the meniscus protrudes most in the discharge direction.

This allows the meniscus to be pulled into the direction opposite to the discharge direction when the meniscus is at the maximum speed in the discharge direction. As a result, the residual vibration after the previous ink discharge is almost eliminated, and the operation can proceed to the next discharge step.

After the second expansion step is ended, the voltage applied to the piezoelectric element 42 by the driving signal producing section 44 is maintained at VM, and the operation proceeds to an expansion step in the next ink discharge.

The time for which the voltage applied to the piezoelectric element 42 is maintained at VM can be shortened by suppressing the residual vibration as in the present invention. In the conventional configuration, the next ink discharge cannot be performed stably with the residual vibration remaining, so that the next ink discharge needs to be suspended until the residual vibration ceases. In the configuration of the present invention, however, the time until the next ink discharge is started can be shortened, so that the ink discharge timing rate can be increased to promote high-speed printing.

For the step times described above, the following expressions preferably hold:

$$Tc/4<T1+T2<Tc \quad (1)$$

$$Tc/4<T3+T4<Tc \quad (2)$$

$$Tc/4<T5+T6<Tc \quad (3)$$

Tc represents the Helmholtz vibration period that depends on the type of the ink and the structure of the pressure chamber and is the vibration period specific to the overall vibration system including the ink and the pressure chamber 40.

The expression (1) is provided for specifying the timing in which the ink is discharged, and means that the discharge is preferably started after the first expansion step and the first holding step in which the meniscus is pulled into the direction opposite to the discharge direction and by the time when the meniscus reaches the maximum speed in the discharge direction (the position of the meniscus is flat).

The expression (2) is provided for specifying the timing in which the second contraction step is started for suppressing the vibration of the meniscus after the discharge, and means that the second contraction step is preferably started to restrict the movement of the meniscus in the direction opposite to the discharge direction after the first contraction step and the second holding step in which the meniscus protrudes in the discharge direction and by the time when the meniscus reaches the maximum speed in the direction opposite to the discharge direction (the position of the meniscus is flat).

The expression (3) is provided for specifying the timing in which the second expansion step is started for further suppressing the vibration of the meniscus, and means that the second expansion step is preferably started to restrict the movement of the meniscus in the discharge direction after the second contraction step and the third holding step in which the meniscus is pulled into the direction opposite to the discharge direction and by the time when the meniscus reaches the maximum speed in the discharge direction (the position of the meniscus is flat).

In the present embodiment, the step times T1 to T7 are the same time, and each of the step times is Tc/4 in terms of the Helmholtz vibration period Tc.

Since each step time is Tc/4, the single ink discharge step (first expansion step T1+first holding step T2+first compression step T3+second holding step T4) corresponds to Tc. The step for suppressing the residual vibration (second compression step T5+third holding step T6) corresponds to Tc/2.

In this manner, the single ink discharge is matched with the Helmholtz vibration period, and the step for suppressing the residual vibration before the next ink discharge is set at a half of the Helmholtz vibration period, thereby enabling more effective suppression of the residual vibration.

Assuming that the difference between the applied voltage VM in the initial state and the applied voltage VL in the compression of the pressure chamber 40 is V1, and that the difference between the applied voltage VH in the suppression of the residual vibration and the applied voltage VM in the initial state is V2, the values of V1 and V2 are determined as appropriate for the viscosity of the ink.

Specifically, when the ink has a high viscosity, sufficient discharge cannot be performed unless the pressure chamber 40 is significantly expanded and contracted, so that the applied voltage V1 in the ink discharge needs to be set at a high value. On the other hand, since the residual vibration is not considerably large at the high viscosity of the ink, the applied voltage V2 in the suppression of the residual vibration may have a low value.

When the ink has a low viscosity, sufficient discharge can be performed even when the pressure chamber 40 is not significantly expanded or contracted. On the other hand, since the residual vibration is large at the low viscosity of the ink, the applied voltage V2 in the suppression of the residual vibration needs to have a high value.

Figure 3:
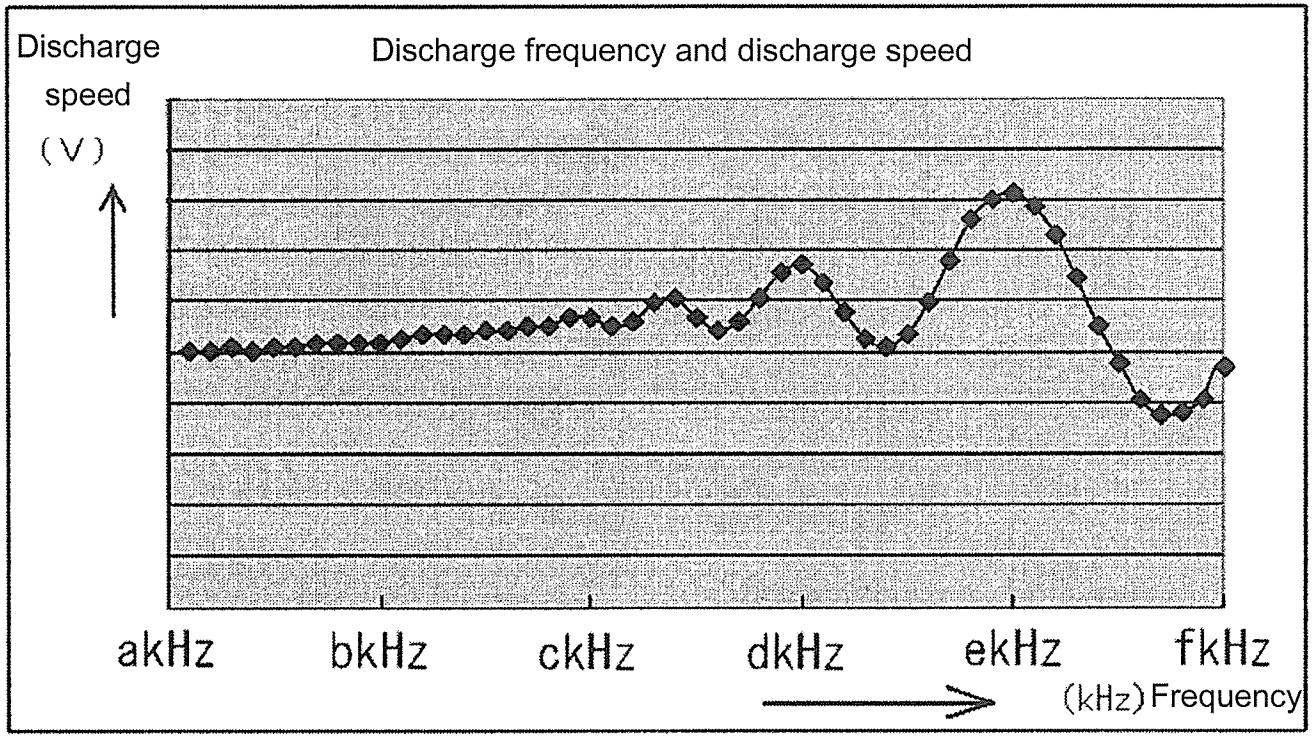
FIG. 3 is a graph showing the frequency characteristics of an ink discharge speed when residual vibration is not suppressed.

Next, FIG. 3 shows ink discharge frequency characteristics when the voltage for suppressing the residual vibration is not applied after the ink discharge. In FIG. 3, the horizontal axis represents the ink discharge frequency (discharge frequency) and the vertical axis represents the ink discharge speed.

Referring to FIG. 3, the discharge speed is almost constant and stable until the frequency reaches approximately c kHz. After the frequency exceeds c kHz, the discharge speed is gradually increased and reduced, and the amplitude is gradually increased. This represents that, when the residual vibration is not suppressed, the ink discharge cannot be performed at a stable speed in a high discharge timing rate. In the graph shown by FIG. 3, a speed difference of 44% occurs at maximum. Although no influence of the residual vibration is seen until c kHz in FIG. 3, the periodic changes at frequencies higher than c kHz can show the period of the residual vibration.

Figure 4:
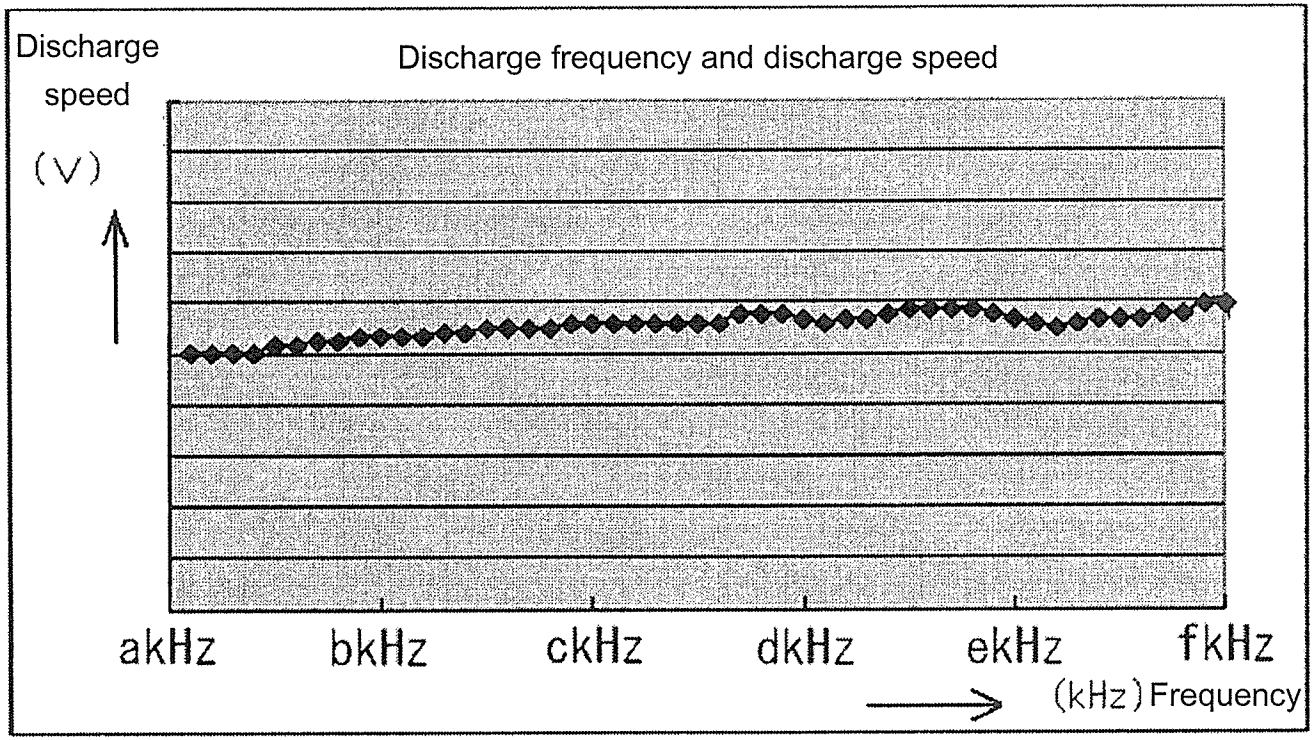
FIG. 4 is a graph showing the frequency characteristics of the ink discharge speed when the residual vibration is suppressed.
Figure 5:
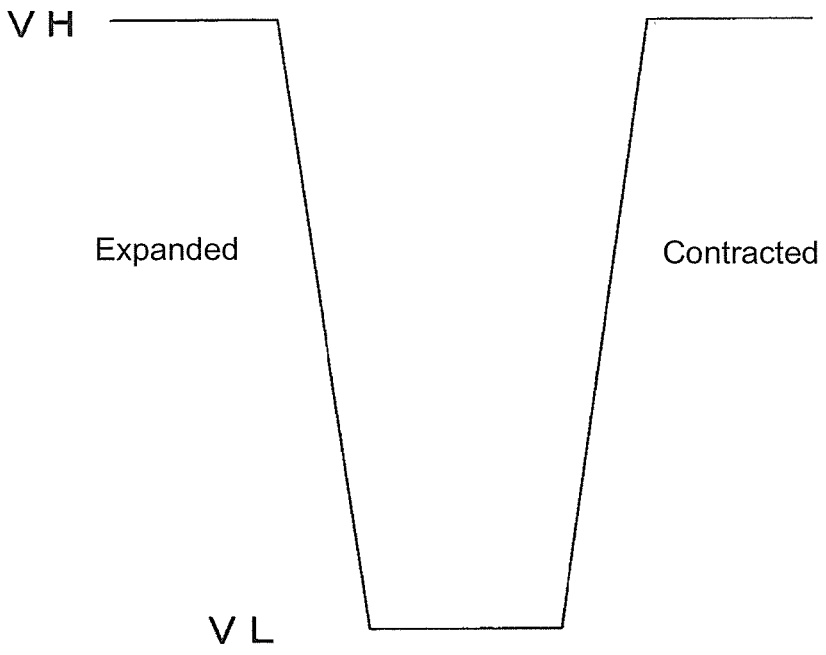
FIG. 5 is an explanatory drawing showing the waveform of a voltage applied to a conventional piezoelectric element.

FIG. 4 shows ink discharge frequency characteristics when the step of suppressing the residual vibration is performed after the step of the ink discharge as in the present embodiment. In FIG. 4, the horizontal axis represents the ink discharge frequency (discharge frequency) and the vertical axis represents the ink discharge speed, similarly to FIG. 3.

As shown in FIG. 4, the step of suppressing the residual vibration is performed as in the embodiment described above to provide an almost constant ink discharge speed even when the ink discharge frequency is increased (that is, the ink discharge period is shortened).

Since the configuration of the present embodiment can be used to suppress the residual vibration, the ink discharge timing rate can be increased to achieve faster printing. Although a speed difference of 10% occurs at maximum in the graph shown by FIG. 4, the discharge speed is extremely stable as compared with the example shown by FIG. 3.

In the recording head 32 in the embodiment described above, the expansion step of expanding the pressure chamber is performed by reducing the voltage of the driving signal, and the contraction step of contracting the pressure chamber is performed by increasing the voltage of the driving signal.

In the present invention, however, the voltage change in the driving signal may be opposite to the one described above. Specifically, the expansion step of expanding the pressure chamber may be performed by increasing the voltage of the driving signal, and the contraction step of contracting the pressure chamber may be performed by reducing the voltage of the driving signal.

After the second contraction step, the driving signal producing section 44 produces the driving signal so as to perform the second expansion step of expanding the pressure chamber 40 to return to the same volume as that at the starting point of the expansion step. This expands the pressure chamber 40 such that the meniscus moved in the discharge direction in the previous second contraction step is moved in the direction opposite to the discharge direction. Thus, the residual vibration can be suppressed reliably.

The driving signal producing section 44 produces the driving signal so as to perform the first holding step of holding the volume of the pressure chamber 40 set at the time of the end of the first expansion step for the certain time after the first expansion step and before the first contraction step. This causes the meniscus to be pulled once into the direction opposite to the discharge direction and waits until the meniscus once pulled into the direction opposite to the discharge direction is turned to the discharge direction and reaches the maximum speed in the discharge direction. In the first holding step, the timing is waited for such that the ink discharge in the subsequent first contraction step can be started at the maximum speed of the meniscus in the discharge direction in the first contraction step, so that the ink discharge can be performed smoothly and stably.

The driving signal is produced so as to perform the second holding step of holding the volume of the pressure chamber 40 set at the time of the end of the first contraction step for the certain time, after the first contraction step and before the second contraction step. Consequently, the timing is waited for to allow the start of the pressing in the discharge direction in the subsequent second contraction step when the meniscus is moved from the furthermost position in the discharge direction, is turned to the direction opposite to the discharge direction, and reaches the maximum speed in the direction opposite to the discharge direction. This can suppress the residual vibration more effectively.

The driving signal is produced so as to perform the third holding step of holding the volume of the pressure chamber 40 set at the time of the end of the second contraction step for the certain time, after the second contraction step and before the second expansion step. This causes the meniscus moved in the direction opposite to the discharge direction to be turned to the discharge direction and waits until the meniscus reaches the maximum speed in the discharge direction. In the third holding step, the timing is waited for so as to expand the meniscus in the pulling direction when the meniscus is at the maximum speed in the discharge direction in the subsequent third expansion step. This can suppress the residual vibration more effectively.

The expression $Tc/4<T1+T2<Tc$ can be satisfied to specify the timing for discharging the ink such that the discharge is started by the time when the meniscus reaches the maximum speed in the discharge direction (the position of the meniscus is flat).

The expression $Tc/4<T3+T4<Tc$ can be satisfied to specify the timing for starting the second contraction step for suppressing the vibration of the meniscus after the discharge such that the step is started by the time when the meniscus reaches the maximum speed in the direction opposite to the discharge direction (the position of the meniscus is flat).

The expression $Tc/4<T5+T6<Tc$ can be satisfied to specify the timing for starting the second expansion step for suppressing the vibration of the meniscus after the discharge such that the step is started by the time when the meniscus reaches the maximum speed in the discharge direction (the position of the meniscus is flat).

The step times for the first expansion step, the first holding step, the first contraction step, the second holding step, the second contraction step, the third holding step, and the second expansion step are the same time, and each of the step times is Tc/4 in terms of the Helmholtz vibration period Tc. As a result, the optimal step time appropriate for the type of the ink can be set to suppress the residual vibration more effectively.

The invention claimed is:

1. An ink-jet recording apparatus, comprising:

a recording head, including a pressure chamber and a nozzle, the pressure chamber containing an ink, the nozzle communicating with the pressure chamber and the nozzle having an opening portion for discharging the ink;

a piezoelectric element, for forming part of the pressure chamber; and a driving signal producing section, for producing a driving signal to be input to the piezoelectric element to change a volume of the pressure chamber, wherein the driving signal producing section produces the driving signal to perform:

a first expansion step of expanding the pressure chamber;

a first contraction step of contracting the pressure chamber to discharge the ink after the first expansion step; and a second contraction step of contracting the pressure chamber in a timing in which a meniscus is pulled into a direction opposite to a discharge direction after the first contraction step, and the driving signal output by the driving signal producing section is set such that a potential at an end point of the second contraction step is set to be positioned in a range opposite to a potential at an end point of the first expansion step with respect to a potential at a starting point of the first expansion step, and such that the potential at the starting point of the first expansion step is set to be substantially the same as a potential at a starting point of the second contraction step;

wherein the driving signal producing section produces the driving signal such that a first holding step of holding the volume of the pressure chamber set after the first expansion step is performed between the first expansion step and the first contraction step to allow start of the discharge of the ink in the first contraction step in a timing in which the meniscus is first moved in the discharge direction, after a force of moving the meniscus in the direction opposite to the discharge step is applied in the first expansion step;

each of a half of a vibration period of the meniscus in the first expansion step and the first holding step, of a half of a vibration period of the meniscus in the first contraction step and the second holding step, and of a half of a vibration period of the meniscus in the second contraction period and the third holding step ranges between Tc/4 to 1Tc, where Tc represents the Helmholtz vibration period.

2. The ink-jet recording apparatus according to claim 1, wherein the driving signal producing section produces the driving signal such that a second holding step of holding the volume of the pressure chamber set after the first contraction step is performed between the first contraction step and the second contraction step to allow start of contraction of the pressure chamber in the second contraction step in a timing in which the meniscus is first pulled into the direction opposite to the discharge direction, after the ink is discharged in the first contraction step.

3. The ink-jet recording apparatus according to claim 2, wherein the second contraction step is started at the time when the meniscus is at the maximum speed of movement pulled into the direction opposite to the discharge direction.

4. The ink-jet recording apparatus according to claim 1, wherein a potential difference between a starting point and an end point of the driving signal to perform the first expansion step is larger than a potential difference between a starting point and an end point of the driving signal to perform the second expansion step.

5. The ink-jet recording apparatus according to claim 2, wherein the driving signal producing section produces the driving signal such that a second expansion step of expanding the pressure chamber to return to the same potential as that at the starting point of the first expansion step is performed after the second contraction step.

6. The ink-jet recording apparatus according to claim 1, wherein the driving signal producing section produces the driving signal such that a second expansion step of expanding the pressure chamber to return to the same potential as that at the starting point of the first expansion step is performed after the second contraction step.

7. The ink-jet recording apparatus according to claim 4, wherein the driving signal producing section produces the driving signal such that a third holding step of holding the volume of the pressure chamber set after the second contraction step is performed between the second contraction step and the second expansion step to allow start of expansion of the pressure chamber in the second expansion step in a timing in which the meniscus is first moved in the discharge direction, after a force of moving the meniscus in the discharge direction is applied in the second contraction step.

8. The ink-jet recording apparatus according to claim 7, wherein the second expansion step is started at the time when the meniscus is at the maximum speed of movement in the discharge direction.

9. The ink-jet recording apparatus according to claim 1, wherein the first contraction step is started at the time when the meniscus is at the maximum speed of movement in the discharge direction.

10. The ink-jet recording apparatus according to claim 1, wherein the first expansion step, the first holding step, the first contraction step, the second holding step, the second contraction step, the third holding step, and the second expansion step have the same step time, and the step time corresponds to Tc/4, where Tc represents the Helmholtz vibration period.

* * * * *